US006137968A

United States Patent [19]

Sunou et al.

[11] Patent Number: 6,137,968

[45] Date of Patent: Oct. 24, 2000

[54] IMAGE FORMING APPARATUS

[75] Inventors: Kazuo Sunou; Junji Shirakawa; Takayuki Muneyasu, all of Ibaraki, Japan

[73] Assignee: Hitachi Koki Company Limited, Tokyo, Japan

[21] Appl. No.: 09/429,029

[22] Filed: Oct. 29, 1999

[30] Foreign Application Priority Data

Oct. 30, 1998 [JP] Japan ..... 10-309890
Dec. 11, 1998 [JP] Japan ..... 10-352235

[51] Int. Cl.[7] ..... G03G 15/00

[52] U.S. Cl. ..... 399/23; 271/153

[58] Field of Search ..... 399/23, 381, 388, 399/43, 21, 22, 18; 271/258.01, 259, 152, 153, 154

[56] References Cited

U.S. PATENT DOCUMENTS 4,320,961 3/1982 Davis et al. ..... 399/22
4,734,747 3/1988 Okuda et al. ..... 399/23
5,398,101 3/1995 Takada et al. ..... 399/43

FOREIGN PATENT DOCUMENTS 757 964 2/1997 European Pat. Off. .
6-144642 5/1994 Japan ..... B65H 7/04

*Primary Examiner*—Quana M. Grainger
*Attorney, Agent, or Firm*—Sughrue, Mion, Zinn, Macpeak, & Seas, PLLC

[57] ABSTRACT

There are disposed optical sensors (S1, S2, S3,S4, S5, and S6) outside sheet trays (1, 2, 3). The optical axes of the optical sensors are respectively set in such a manner that they are parallel to their associated up-down tables (1*a*, 2*a*, and 3*a*) and pass upwardly of contact positions (A, B and C) between sheets (P) and sheet supply rollers (20, 21, and 22). Using these optical sensors, the present image forming apparatus is able to detect a first condition based on information as to whether a sheet is positioned at a sheet suppliable position on the up-down table of the sheet tray or not, a second condition based on information as to whether a sheet position restrict member (23) removably mounted on the sheet tray is set properly or not, a third condition based on information as to whether a foreign object has invaded the apparatus main body side or not when the sheet tray was removed from the apparatus main body, and a fourth condition based on information on the warped amount and/or folded amount of the sheet.

2 Claims, 3 Drawing Sheets

IMAGE FORMING APPARATUS

BACKGROUND OF THE INVENTION

1. Field of the Invention

The present invention relates to an image forming apparatus such as a laser printer, a copying machine or the like.

2. Description of the Related Prior Art

In a conventional image forming apparatus, there are employed various mechanisms: for example, a mechanism in which an optical sensor for detecting a sheet placement position is disposed in the inside of a sheet tray, a mechanism in which a switch or an actuator using an optical sensor is disposed upwardly of a sheet placement position, and the like.

Specifically, in the conventional mechanism in which the optical sensor for detecting the sheet placement position is disposed in the inside of the sheet tray, since it is necessary to detect a plurality of sheets, a plurality of optical sensors are necessary. On the other hand, in the conventional mechanism using the switch or actuator, because the switch or actuator comes into contact with the sheet or sheet tray, there is raised a problem that the switch or actuator can be damaged.

A conventional image forming apparatus which is capable of detecting a plurality of abnormal conditions in a sheet supply part thereof using a small number of optical sensors is disclosed in Japanese Patent Publication No. 6-144642 of Heisei.

According to the image forming apparatus of Japanese Patent Publication No. 6-144642 of Heisei, there is disclosed a structure in which presence or absence of a sheet within a sheet tray is detected by an optical sensor disposed near a sheet feed roller, and, when there exists a sheet which is pushed out of the sheet tray in the non-recording time, this condition is detected as defective sheet supply; that is, the two kinds of abnormal conditions (presence/absence of sheet, and defective sheet supply) can be detected by a pair of optical sensors.

However, in the structure disclosed in Japanese Patent Publication No. 6-144642 of Heisei, the optical axis of the optical sensor is disposed in the sheet feed-out opening of the sheet tray and, therefore, for example, when the rear end portion of a sheet placed in the sheet tray is folded, even though the folded portion of the sheet is deviated from the optical axis of the optical sensor, the optical sensor is not able to detect the folded portion of the sheet, which results in the jammed sheets or in the poor sheet printing.

SUMMARY OF THE INVENTION

An object of the present invention is to eliminate the drawbacks found in the conventional structure disclosed in the above-cited Japanese Patent Publication No. Hei. 6-144642 and to provide new image forming apparatus which is able to detect a plurality of abnormal conditions with a small number of optical sensors, is simplified in structure, and is enhanced in the reliability of a sheet supply part thereof.

In attaining the above object, according to the invention, there is provided an image forming apparatus, comprising: a sheet tray including an upward and downward movable sheet placement table and disposed in a main body of the present image forming apparatus in such a manner that it can be removed from the apparatus main body; a sheet supply roller disposed upwardly of the table for paying out and feeding the upper-most one of sheets placed on the table of the sheet tray; and, control means for recognizing that the upper surface of the table or the upper-most surface of the placed sheet is in contact with the sheet supply roller, thereby being able to keep the position of the upper-most surface of the placed sheet at a constant level, the present image forming apparatus being characterized by an optical sensor which is disposed outside the sheet tray in such a manner that the optical axis of the optical sensor set parallel to the upper surface of the table passes upwardly of a contact position between the placed sheet and the sheet roller, and also which is able to detect a first condition based on information as to whether the sheet is positioned at a sheet suppliable position on the table of the sheet tray or not, a second condition based on information as to whether a sheet position restrict member removably mounted on the sheet tray is set properly or not, a third condition based on information as to whether a foreign object has invaded the main apparatus body side or not when the sheet tray was removed from the apparatus main body, and a fourth condition based on information on the warped amount and/or folded amount of the placed sheet.

DETAILED DESCRIPTION OF THE PRESENT INVENTION

Now, the present invention of an image forming apparatus will be described below with reference to the accompanying drawings.

At first, there will be described a laser printer as the image forming apparatus and description will be given generally of the whole structure of the present laser printer with reference to FIG. 3.

Figure 3:
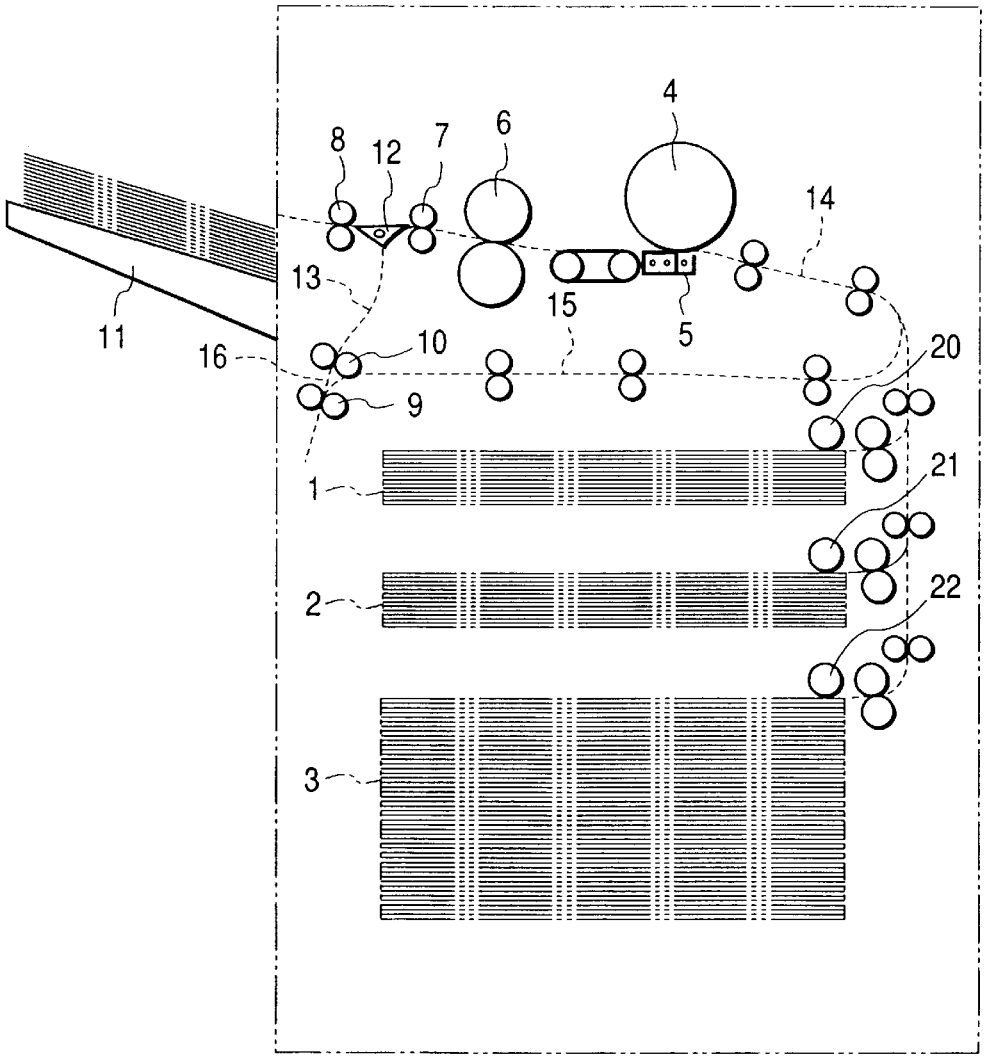
FIG. 3 is a schematic view of the structure of a whole image forming apparatus according to the invention.

In FIG. 3, reference characters 1, 2 and 3 respectively designate sheet trays for storing sheets therein. And, 4 stands for a photoconductor drum which is rotatable in accordance with a signal sent from a controller (not shown). If the photoconductor drum 4 starts to rotate, then the surface of the photoconductor drum 4 is electrically charged uniformly by a corona charger device (not shown). On the charged photoconductor drum 4, there is formed an electrostatic latent image byan optical system (not shown). If the electrostatic latent image reaches the position of a developer device (not shown), then it is developed by toner and is thereby visualized on the photoconductor drum 4 as a toner image. The toner image formed in this manner by a known electrophotographic process is transferred by a transfer device 5 to a sheet which is fed out from the sheet tray 1, 2, or 3. Reference character 6 designates a fixing device which fixes the toner image transferred to the sheet. By the way, 12 stands for a gate member which switches the direction of the sheet being transferred, and 11 designates a sheet discharge tray on which the sheet with the image formed thereon is placed.

And, 14 designates a sheet supply path which is disposed as a sheet delivery path for connecting together the sheet supply part 1, 2 or 3—the image forming means 4, 5 and 6—the sheet discharge tray 11. Also, 13 stands for a draw-in path which is disposed in such a manner that it branches off from the sheet supply path 14 on the sheet feed direction downstream side thereof with respect to the image forming means 4, 5, 6 and also which is used to draw in selectively the sheet fed out from the fixing device 6 by switching the gate 12. Further, 15 stands for a return path which is disposed in such a manner that it branches off from the intermediate portion of the draw-in path 13 and the terminal end portion thereof meets the sheet supply path 14 on the sheet feed direction upstream side thereof with respect to the image forming means 4, 5, 6.

Therefore, in carrying out image recording on both sides of a sheet, the sheet fed out from the fixing device 6 is drawn into the draw-in path 13, and the thus drawn-in sheet is sent out to the return path 15 to thereby send the sheet with one side recorded into the image forming means, whereby image recording on both sides can be carried out. By the way, in FIG. 3, 7 and 8 respectively designate feed rollers which are disposed before and behind the gate member 12; 9, 10 respectively stand for feed or supply rollers which are disposed on the draw-in path 13 and can be switched between their respective forward rotation and reversed rotation; and, 16 designates a gate member used to guide the sheet, which has been drawn into the draw-in path 13, to the return path 15, or guide such drawn-in sheet in such a manner as to return the same again to the sheet supply path 14 side.

Figure 1:
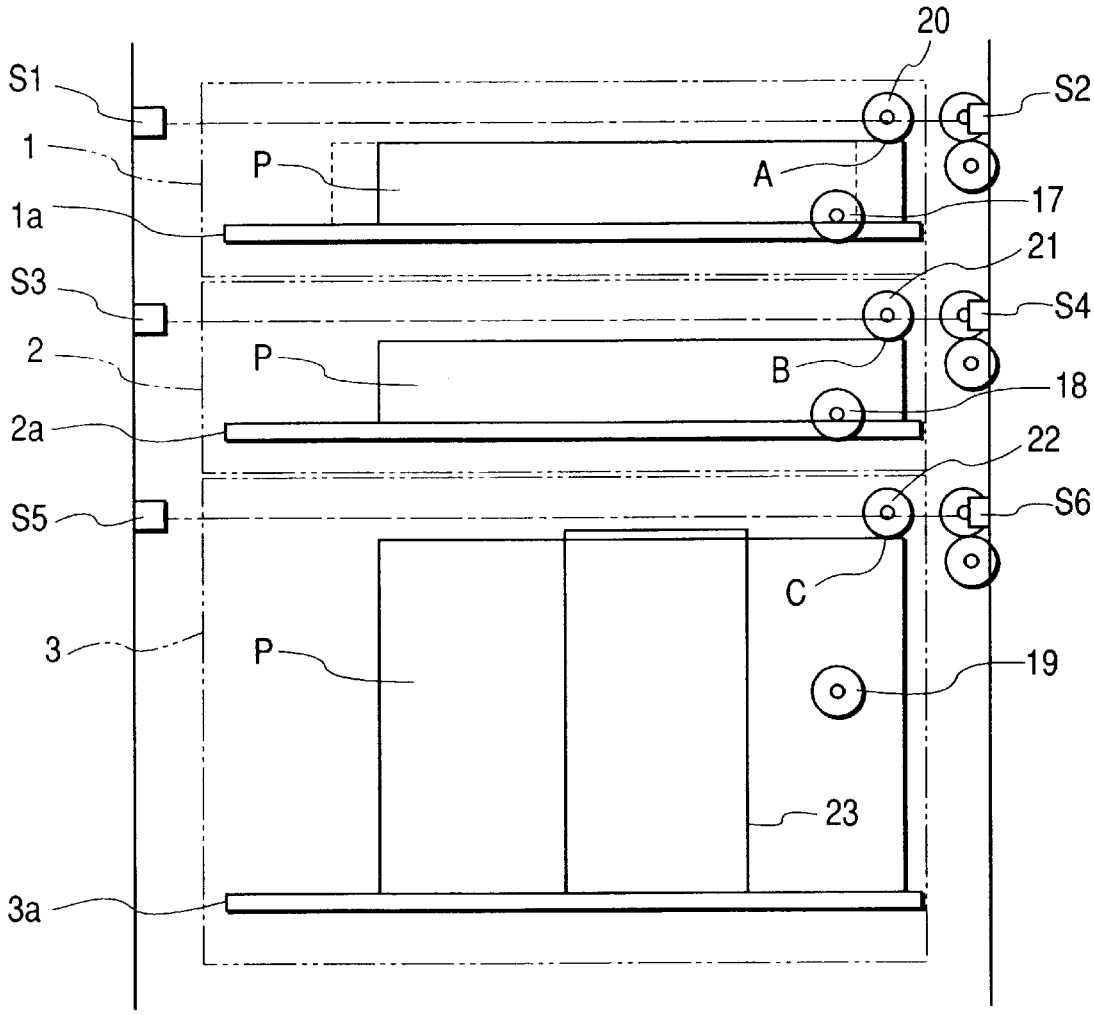
FIG. 1 is a schematic view of a structure of a sheet supply part of an image forming apparatus according to the invention.
Figure 2:
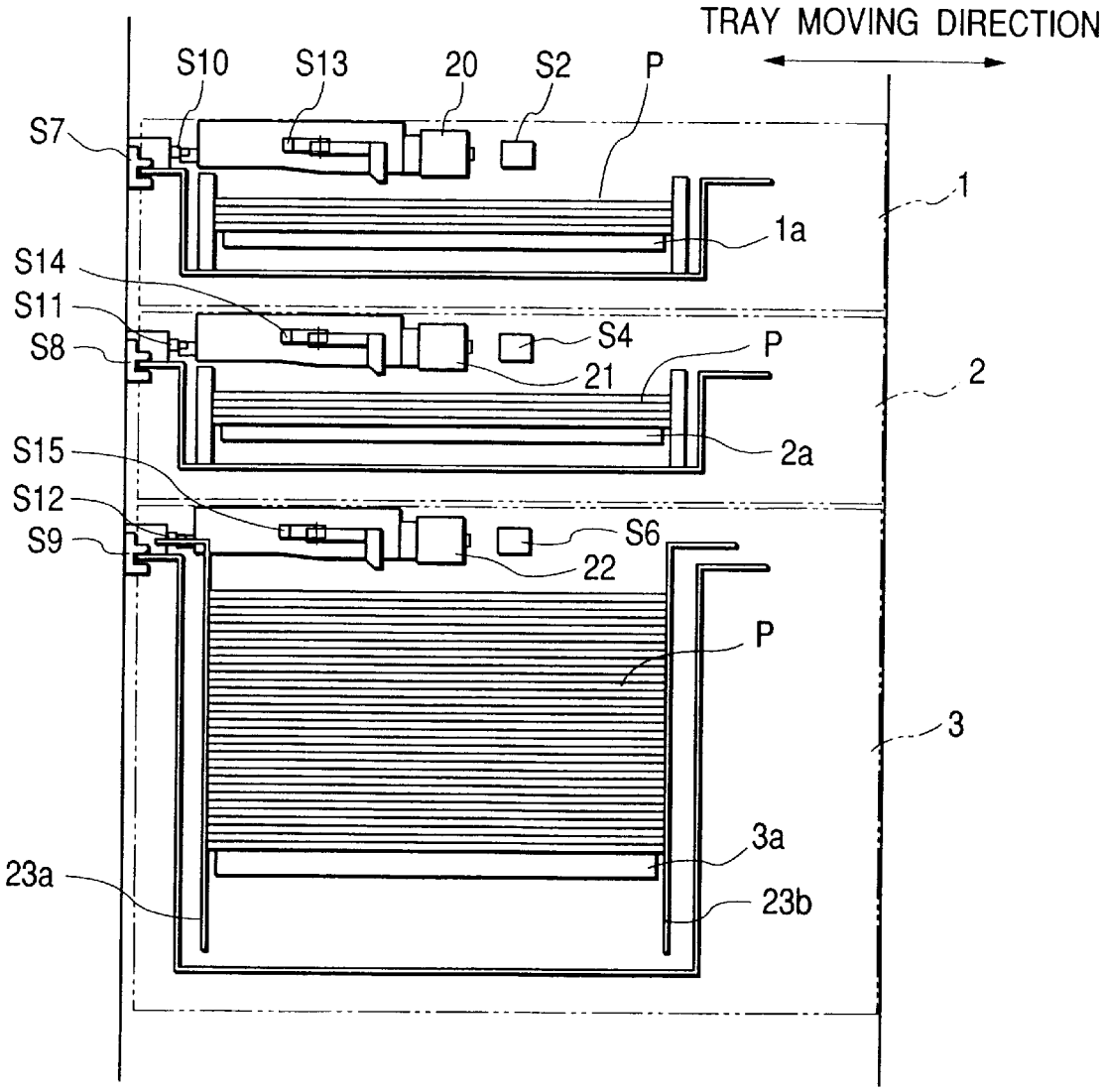
FIG. 2 is another schematic view of the structure of the above sheet supply part according to the invention.

Next, description will be given below of the structure of the above-mentioned sheet supply part 1, 2, 3 with reference to FIGS. 1 and 2. Here, FIG. 1 is a schematically enlarged view of the sheet control part in correspondence to FIG. 3, and FIG. 2 is a view of the sheet supply part when it is viewed from the left side thereof. The sheet trays 1, 2, and 3 can be respectively drawn in a perpendicular direction with respect to the sheet surface of FIG. 1 and also can be removed from the main body of the laser printer. When a sheet tray is prepared for each size of sheets, the sheet trays 1, 2, and 3 can be replaced with such tray.

Within the respective sheet trays 1, 2, and 3, there are disposed their associated up-down (upward and downward movable) tables 1*a*, 2*a* and 3*a*. If the sheet trays 1, 2 and 3 are pushed into their respective given mounting positions and are thereby loaded into the laser printer main body, then optical sensors S7, S8 and S9 respectively shown in FIG. 2 detect such loading of the respective sheet trays 1, 2 and 3 and thus the up-down tables 1*a*, 2*a* and 3*a* are respectively fitted with their associated up-down table driving gears 17, 18 and 19, so that the rising operations of the up-down tables 1*a*, 2*a* and 3*a* are carried out until the upper-most surfaces of sheets placed on the up-down tables 1*a*, 2*a* and 3*a* (when no sheet is present on the up-down tables 1*a*, 2*a* and 3*a*, the upper surfaces of the up-down tables 1*a*, 2*a* and 3*a*) respectively come in contact with their associated sheet supply rollers 20, 21 and 22. Here, the sheet supply rollers 20, 21 and 22 are supported in such a manner that they can be moved in the upward and downward directions. If the sheet supply rollers 20, 21 and 22 are moved upward due to the above-mentioned rising operations of the up-down tables 1*a*, 2*a* and 3*a*, then the upward movements of the sheet supply rollers 20, 21 and 22 are respectively monitored by their associated optical sensors S10, S11 and S12 (see FIG. 2); and, if the optical sensors S10, S11 and S12 respectively detect that the sheet feed rollers 20, 21 and 22 have been respectively raised up to their previously set sheet supply positions, then the rising operations of the up-down tables 1*a*, 2*a* and 3*a* are caused to stop. Also, in FIG. 2, reference characters S13, S14 and S15 respectively designate optical sensors which are used to detect whether a sheet is present or not. When the optical sensors S10, S11 and S12 are respectively on, that is, when an object to be detected is present on each of the optical axes of the optical sensors S10, S11 and S12 and the light is thereby shaded, if the optical sensors S13, S14 and S15 are detected, then this condition is judged to show that no sheet is present and, therefore, there is output a no-sheet signal.

In the sheet supply part, on a fixed member disposed outside of the sheet trays 1, 2 and 3, for example, on the frame of the laser printer main body, there are mounted nonconnectable sensors S1, S2, S3, S4, S5 and S6 such as photosensors or the like. Specifically, the two photosensors S1 and S2 form a pair; the two photosensors S3 and S4 form a pair; and, the two photosensors S5 and S6 form a pair. The optical axes of each pair of photosensors are set in such a manner that they respectively pass upwardly of sheet supply positions A, B and C in the sheet trays 1, 2 and 3.

By the way, in FIG. 1, reference character 23 (in FIG. 2, it corresponds to 23*a* and 23*b*) designates a sheet position restrict member which is removably mounted on the sheet tray 3 having a large capacity. Also, P stands for a sheet that is placed on each of the sheet trays 1, 2 and 3.

Thanks to the above-mentioned structure, in the image forming apparatus according to the invention, a plurality of abnormal conditions can be respectively detected by a pair of photosensors: that is, there can be detected an abnormal condition in which a sheet is not positioned properly in a sheet tray selected; an abnormal condition in which the sheet position restrict member 23 is not set properly; an abnormal condition in which a foreign object has invaded into the sheet tray mounting portion; and, an abnormal condition in which a sheet placed in the sheet tray is warped and/or folded.

Now, description will be given below of the operations to detect the respective abnormal conditions with reference to FIGS. 1 and 2 as well as Table 1. Here, Table 1 shows the combinations of the respective sensor signals that are output from their associated sensors and are used to detect the plurality of abnormal conditions. In Table 1, [ON] means a case in which an object to be detected is present on the optical axis of the photosensor and the light is thereby shaded, whereas [OFF] means a case in which no object to be detected is present on the optical axis of the photosensor. By the way, in Table 1, [ON/OFF] means that either ON or OFF is possible.

TABLE 1

| Name of | 1st condition (Poor positioning of Sheet) | | | 2nd condition (Poor mounting of restrict member) | | | 3rd condition (Invasion of foreign object) | | | 4th condition (Poor condition of sheet) | | |
|---|---|---|---|---|---|---|---|---|---|---|---|---|
| Sensors | Tray 1 | Tray 2 | Tray 3 | Tray 1 | Tray 2 | Tray 3 | Tray 1 | Tray 2 | Tray 3 | Tray 1 | Tray 2 | Tray 3 |
| S1,S2 | ON | — | — | — | — | — | OFF | ON/OFF | ON/OFF | ON | — | — |
| S3,S4 | — | ON | — | — | — | — | ON/OFF | ON/OFF | ON/OFF | — | ON | — |
| S5,S6 | — | — | ON | — | — | ON | ON/OFF | OFF | ON/OFF | — | — | ON |
| S7 | ON | — | — | — | — | — | ON | OFF | ON/OFF | ON | — | — |
| S8 | — | ON | — | — | — | — | OFF | ON | ON/OFF | — | ON | — |
| S9 | — | — | ON | — | — | OFF | ON/OFF | ON/OFF | ON | — | — | ON |
| S10 | OFF | — | — | — | — | — | ON | OFF | ON/OFF | ON | — | — |
| S11 | — | OFF | — | — | — | — | OFF | ON | ON/OFF | — | ON | — |
| S12 | — | — | OFF | — | — | OFF | ON/OFF | ON/OFF | ON | — | — | ON |
| S13 | ON | — | — | — | — | — | OFF | ON | ON/OFF | OFF | — | — |
| S14 | — | ON | — | — | — | — | ON | OFF | ON/OFF | — | OFF | — |
| S15 | — | — | ON | — | — | — | ON/OFF | ON/OFF | OFF | — | — | OFF |

As a first case, when the sheet P is not positioned properly on the up-down table 1*a* of the sheet tray 1 selected, for example, when the sheet P is positioned shifted to the left as shown by a broken line in FIG. 1 and thus the upper surface of the sheet P is not positioned in such a manner that it faces just below the sheet supply roller 20, there does not occur such a condition that the sheet supply roller 20 is pushed up by the upper surface of the sheet P and, therefore, the optical sensor S10 is not detected but the optical sensor S13 remains detected. In this case, the up-down table 1*a* judges that the upper surface of the sheet P does not reach the sheet supply position, and thus the rising operation of the up-down table 1*a* continues. If the rising operation of the up-down table 1*a* continues and thus the upper surface of the sheet P reaches the optical axes of the photosensors S1 and S2, then the rising operation of the up-down table 1*a* is caused to stop in accordance with outputs respectively issued from the photosensors S1 and S2, and a signal telling an abnormal condition is output to the control part (not shown) of the laser printer or the like.

As a second case, when the sheet position restrict member 23 of the sheet tray 3 is not set properly, that is, when, although the upper end of the sheet position restrict member 23 is set in such a floated condition as the upper end reaches the optical axes of the photosensors S5 and S6, the sheet tray 3 has been mounted on the laser printer main body, then the photosensors S5 and S6 are detected before the optical sensors S9 and S12 and, therefore, this condition is judged to be an abnormal condition. In this case, the up-down table 3*a* is not raised but a signal telling an abnormal condition is output to the laser printer control part or the like.

As a third case, in a state where the sheet tray is removed from the printer main body and at least one of the optical sensors S7, S8 and S9 are not detected, when, while supplying the sheet to the sheet tray, the hand of an operator or other foreign object has invaded the space from which the sheet tray was removed and the present invader reaches the optical axis of the photosensor, the sheet supply operation is stopped and a signal telling an abnormal condition is output to the laser printer control part or the like.

The relation between ON and OFF of the optical sensors S1–S15 relating to sheet tray 1 in the third condition shown in Table 1 shows the relation between signals in a case where the sheet tray 1 is mounted on the sheet supply part and at least one of the sheet trays 2 and 3 is removed from the laser printer main body, or in a case where both of the sheet trays 2 and 3 are removed from the laser printer main body.

Also, the relation between ON and OFF of the optical sensors S1–S15 relating to sheet tray 2 in the third condition shown in Table 1 shows the relation between signals in a case where the sheet tray 2 is mounted on the sheet supply part and at least one of the sheet trays 1 and 3 is removed from the laser printer main body, or in a case where both of the sheet trays 1 and 3 are removed from the laser printer main body.

Further, the relation between ON and OFF of the optical sensors S1–S15 relating to sheet tray 3 in the third condition shown in Table 1 shows the relation between signals in a case where the sheet tray 3 is mounted on the sheet supply part and at least one of the sheet trays 1 and 2 is removed from the laser printer main body, or in a case where both of the sheet trays 1 and 2 are removed from the laser printer main body.

As a fourth case, when the sheet is warped and/or folded as it is placed into the sheet tray, or when the sheet is warped because the sheet has been left within the sheet tray for a long period of time: and, in more particular, when the warped and/or folded amount of the sheet provides such an amount that the warped and/or folded portion of the sheet reaches the optical axis of the photosensor, in a printing or printable condition that can be detected by the optical sensors S7, S8, S9, S10, S11, and S12 but cannot be detected by the optical sensors S13, S14, and S15, at the time when the warped and/or folded portion of the sheet reaches the optical axes of the photosensors S1, S2, S3, S4, S5, and S6, a signal telling an abnormal condition is output to the laser printer control part or the like.

According to the invention, there can be obtained image forming apparatus which is able to detect a plurality of abnormal conditions by a small number of sensors and thus can be simplified in the structure thereof. Also, there can be obtained image forming apparatus which is improved in the reliability of the sheet supply part thereof.

What is claimed is:

1. An image forming apparatus, comprising:

a main body;

a sheet tray disposed removably from said main body;

a sheet placement table disposed in said sheet tray, said sheet placement table being movable upwardly and downwardly;

a sheet supply roller disposed upwardly of said sheet placement table for discharging and feeding the uppermost one of sheets placed on said sheet placement table of said sheet tray;

a sheet position restrict member removably mounted on said sheet tray;

control means for detecting that the upper surface of said sheet placement table or the upper-most surface of said placed sheet is in contact with said sheet supply roller and for keeping the position of said upper-most surface of said placed sheet at a constant level; and an optical sensor disposed outside of said sheet tray wherein the optical axis of said optical sensor set parallel to said upper surface of said sheet placement table passes above a contact position between said placed sheet and said sheet supply roller, for outputting a signal used for detecting:

a first condition based on information as to whether said sheet is positioned at a sheet suppliable position on said table of said sheet tray or not;

a second condition based on information as to whether the sheet position restrict member is set properly or not;

a third condition based on information as to whether a foreign object has invaded said main body or not when said sheet tray is removed from said apparatus main body; and a fourth condition based on information on the warped amount and folded amount of said sheet.

2. An image forming apparatus comprising:

a main body;

a sheet tray disposed removably from said main body;

a sheet placement table disposed in said sheet tray, said sheet placement table being movable upwardly and downwardly;

a sheet supply roller disposed upwardly of said sheet placement table of discharging and feeding the upper-most one of wheels placed on said table of said sheet tray;

a sheet tray sensor for detecting a mounting condition of said sheet tray with respect to said apparatus main body;

a sheet height sensor for detecting a contact condition of the upper surface of said sheet placement table or the upper-most surface of said placed sheet with respect to said sheet supply roller and for outputting a signal for controlling the position of said upper-most surface of said placed sheet at a constant level;

a sheet position restrict member removable mounted on said sheet tray;

an optical sensor disposed outside of said sheet tray wherein the optical axis of said optical sensor set parallel to said upper surface of said table passes above a contact position between said placed sheet and said sheet supply roller; and control means, in accordance with combinations of signals respectively outputted from said sheet tray sensor, said sheet height sensor and said optical sensor, for detecting:

a first condition based on information as to whether said sheet is positioned at a sheet suppliable position on said sheet placement table of said sheet tray or not;

a second condition based on information as to whether the sheet position restrict member is set properly or not;

a third condition based on information as to whether a foreign object has invaded said main body or not when said sheet tray is removed form said apparatus main body; and a fourth condition based on information on the warped amount and folded amount of said sheet.

* * * * *